US005430226A

United States Patent [19]

Ohuchi et al.

[11] Patent Number: 5,430,226

[45] Date of Patent: Jul. 4, 1995

[54] METHOD FOR REGENERATING SPENT SOLVENT GENERATED FROM NUCLEAR FUEL CYCLE

[75] Inventors: Jin Ohuchi; Isao Kondoh, both of Naka; Takashi Okada, Katsuta, all of Japan

[73] Assignee: Doryokuro Kakunenryo Kaithatsu Jigyodan, Tokyo, Japan

[21] Appl. No.: 907,104

[22] Filed: Jun. 30, 1992

[30] Foreign Application Priority Data

Jul. 12, 1991 [JP] Japan ..... 3-172320

[51] Int. Cl.[6] ..... G21F 9/00

[52] U.S. Cl. ..... 588/20; 210/634; 210/906; 208/18

[58] Field of Search ..... 252/626, 631, DIG. 17; 210/634, 906, 907, 681, 682; 203/18; 588/20

[56] References Cited

U.S. PATENT DOCUMENTS 4,595,529 6/1986 Neace ..... 252/631

5,171,144 12/1992 Kondho et al. ..... 210/634

OTHER PUBLICATIONS

71–Nuclear Technology, vol. 92, No. 14, 118164j.

Chemical Abstracts, vol. 101, No. 22, 195894d.

*Primary Examiner*—Donald P. Walsh

*Assistant Examiner*—Ngoclan T. Mai

*Attorney, Agent, or Firm*—Wenderoth, Lind & Ponack

[57] ABSTRACT

A method for regenerating a spent solvent generated from a nuclear fuel cycle and containing a higher hydrocarbon (n-dodecane), tributyl phosphate and degradation products thereof. The spent solvent is brought into contact with a methanol/water mixture having a water concentration of 100 to 750 g/l and the resulting mixture is subjected to phase separation to form a non-methanol/water phase and a methanol/water phase. The degradation products such as DBP in the spent solvent selectively migrate into the methanol/water phase and n-dodecane and TBP can be recovered as the non-methanol/water phase.

3 Claims, 2 Drawing Sheets

METHOD FOR REGENERATING SPENT SOLVENT GENERATED FROM NUCLEAR FUEL CYCLE

BACKGROUND OF THE INVENTION

The present invention relates to a method for regenerating a spent solvent discharged from a solvent extraction process in a nuclear fuel cycle, such as in reprocessing facilities for spent nuclear fuel or in nuclear fuel manufacturing facilities.

A phospate, such as tributyl phosphate (TBP), diluted with a higher hydrocarbon such as n-dodecane (hereinafter referred to simply as "dodecane") or kerosine is widely used as a solvent in a solvent extraction process in the reprocessing of a spent nuclear fuel or in wet scrap recovery process in nuclear fuel manufacturing facilities.

The spent solvent which was used in the solvent extraction step contains degradation products such as dibutyl phosphate (DBP) and monobutyl phosphate (MBP) formed by the decomposition of a part of TBP by an acid, heat or radiation. Since such degradation products exert a bad influence on phase separation or extraction efficiency when the spent solvent is recycled for reuse, the degradation products are removed by alkali washing with an aqueous solution of sodium hydroxide or sodium carbonate. A radioactive waste containing the degradation products such as DBP thus removed is mixed with a vitrification additive or bituminization additive to form a vitrifed or bituminized solid.

Further, in order to separate TBP, DBP, dodecane, etc. in the spent solvent, there have been used methods such as vacuum freeze-drying and low-temperature vacuum distillation wherein a difference in the boiling point among them is utilized.

However, the method wherein the degradation products are removed by the alkali washing has a defect in that a large amount of the vitrification additive or bituminization additive is necessitated in the vitrification or bituminization of the radioactive waste for stabilizing sodium which has been introduced during the alkali washing, to thereby increase the amount of the waste. Under these circumstances, the development of a method for regenerating the spent solvent which enables the degradation products such as DBP to be removed without using sodium is demanded.

The vacuum freeze-drying and low-temperature vacuum distillation methods have a defect in that a large amount of energy is required to achieve the requisite low temperature and the treatment capacity is small.

SUMMARY OF THE INVENTION

Therefore, an object of the present invention is to provide a method for regenerating a spent solvent which can remove degradation products such as DBP without using sodium or other reagents and enables the amount of generated radioactive waste to be reduced by virture of possible recycling of the regenerated solvent.

Another object of the present invention is to provide a method for regenerating a spent solvent which has advantages in that energy can be saved, since low-temperature processing which requires a large amount of energy is unnecessary, in that the treatment capacity is high and in that continuous processing can be easily conducted.

According to the present invention, there is provided a method for regenerating a spent solvent generated from a nuclear fuel cycle and containing a higher hydrocarbon, tributyl phosphate and degradation products thereof, the method comprising bringing the spent solvent into contact with a methanol/water mixture having a water concentration of 100 to 750 g/l and separating the resulting mixture into a non-methanol/water phase mainly composed of the higher hydrocabon and tributyl phosphate and a methanol/water phase containing the degradation products.

In the present invention as described above, the degradation products such as DBP in the spent solvent migrate into the methanol/water phase, while the higher hydrocarbon and TBP remain in the non-methanol/water phase (mainly composed of the higher hydrocarbon). FIG. 1 is a graph showing the results of determination of the rates of migration of DBP and TBP into the methanol/water phase obtained after mixing a methanol/water mixture having a varied water concentration with a simulated spent solvent (comprising 1% DBP, 29% TBP and 70% dodecane) at 20° C., followed by phase separation. The rate of migration is defined by the following equation:

$$[(\text{amount of component } i \text{ in methanol/water phase})/(\text{total amount of component } i)] \times 100\ (\%).$$

It is apparent from the graph that when 100% methanol is used, both TBP and DBP migrate into the methanol phase almost completely but as the water concentration is increased, the migration of TBP into the methanol/water phase becomes difficult and only DBP migrates thereinto. Thus DBP can be selectively introduced into the methanol/water phase. When the water concentration of the methanol/water mixture is below 100 g/l, the difference in the rate of migration into the methanol/water phase between TBP and DBP is insufficient and, on the contrary, when the water concentration is above 750 g/l, the rate of migration of DBP into the methanol/water phase is also reduced to make an efficient removal of DBP by extraction impossible.

Energy and cost can be saved in the present invention, since the extraction with the methanol/water mixture can be conducted at room temperature. In addition, the treatment capacity can be improved, since the liquid-liquid contact operation can easily made continuous.

When the degradation products cannot be sufficiently removed by conducting the extraction with a methanol/water mixture only once, the obtained non-methanol/water phase can be further brought into contact with the methanol/water mixture to repeat the extraction, if necessary.

PREFERRED EMBODIMENTS OF THE INVENTION

Figure 2:
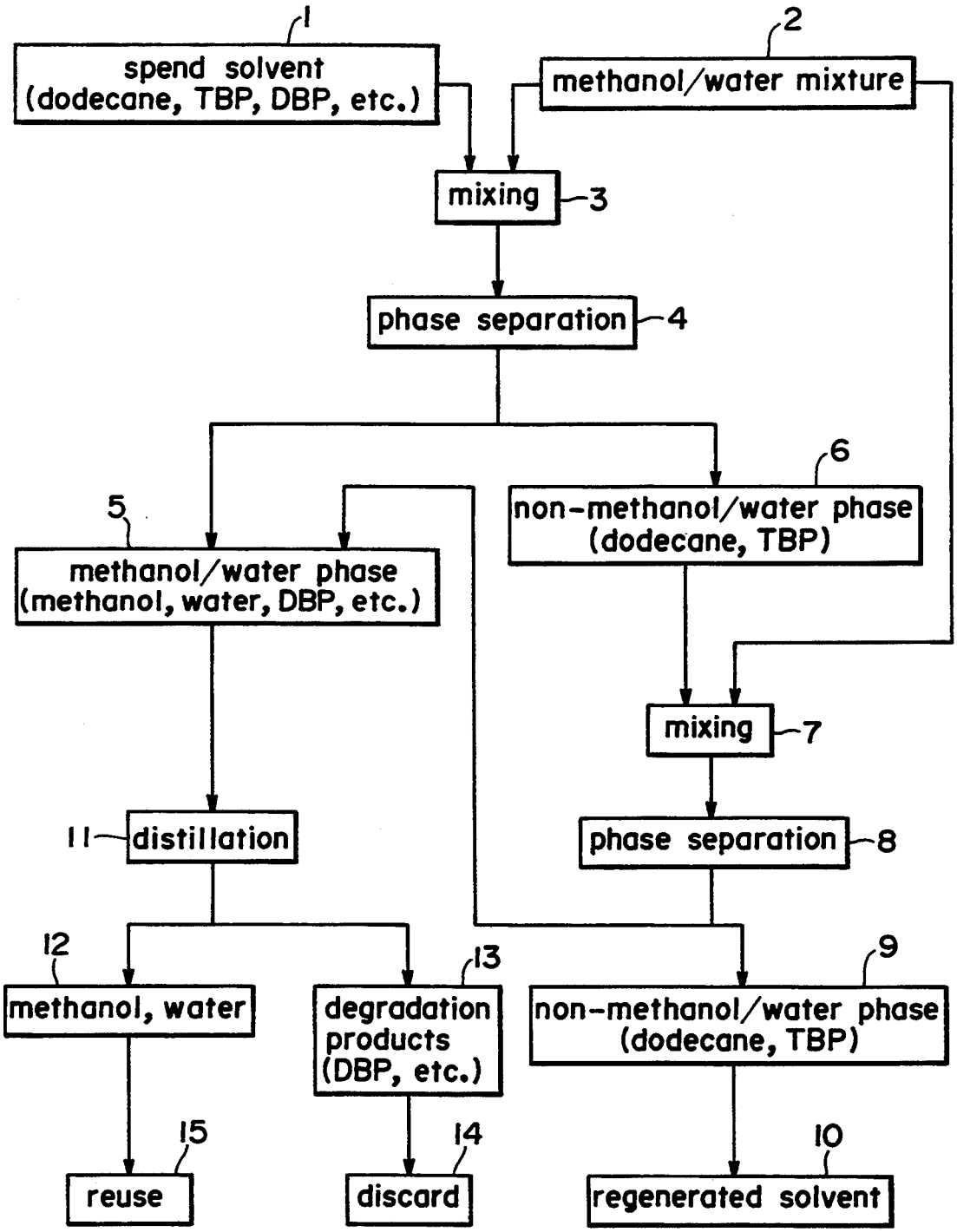
FIG. 2 is a flow chart showing an embodiment of the present invention.

FIG. 2 is a flow chart showing a preferred embodiment of the present invention. A spent solvent 1 comprising dodecane and TBP and containing degradation products such as DBP was mixed 3 with a methanol/water mixture 2 and then subjected to phase separation 4 to separate the resulting mixture into a methanol/water phase 5 and a non-methanol/water phase 6. The selectively extracted, methanol-soluble, relatively hydrophilic degradation products such as DBP are contained in the methanol/water phase 5, and strongly hydrophobic dodecane and TBP are recovered as the non-methanol/water phase 6. The non-methanol/water phase 6 thus obtained is repeatedly subjected to mixing 7 with the methanol/water mixture 2 and phase separation 8 to extract the degradation products such as DBP contained therein in a very small amount into the methanol/water phase 5.

The non-methanol/water phase 9 thus recovered can be reused as a regenerated solvent 10, since the degradation products have been efficiently removed therefrom. On the other hand, the methanol/water phase 5 containing the degradation products is distilled 11 to selectively separate methanol and water 12 each having a relatively high vapor pressure and the residual degradation products 13 are discarded 14. The recovered methanol and water 12 are reused 15, if necessary.

EXAMPLE 1

A simulated spent solvent (comprising 1% DBP, 29% TBP and 70% dodecane) was brought into contact with an equal quantity of a methanol/water mixture (water concentration: 530 g/l) at room temperature and the resulting mixture was subjected to phase separation. By this procedure conducted only once, only DBP (a half of the total amount of DBP) migrated into the methanol/water phase, resulting in selective removal of DBP.

EXAMPLE 2

Figure 1:
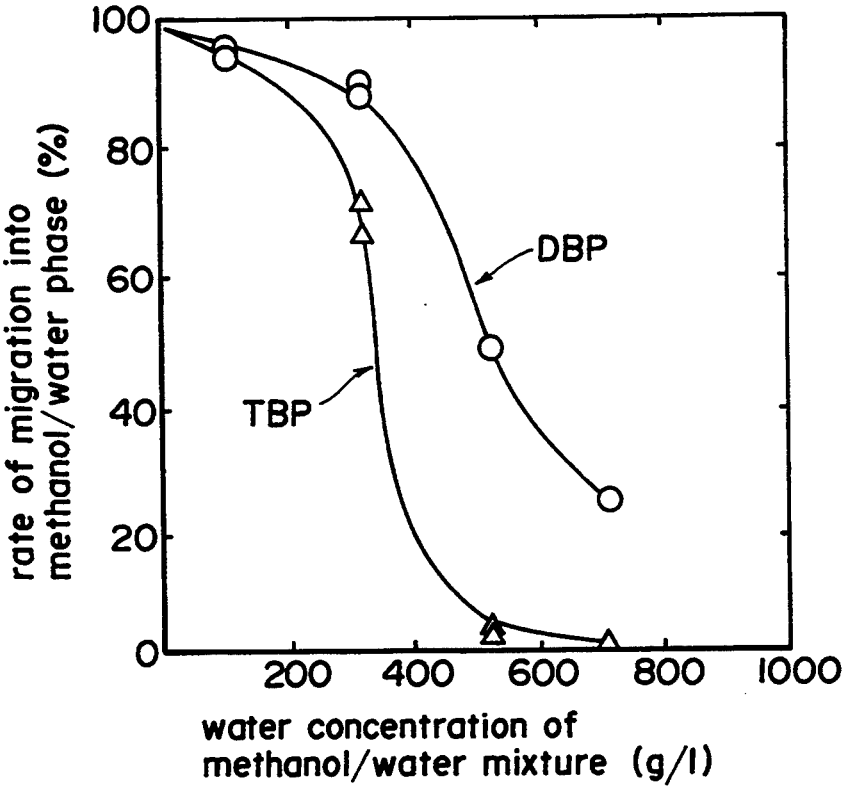
FIG. 1 is a graph showing the rates of migration of DBP and TBP into the methanol/water phase obtained after mixing a methanol/water mixture having a varied water concentration with a spent solvent followed by phase separation.
Figure 3:
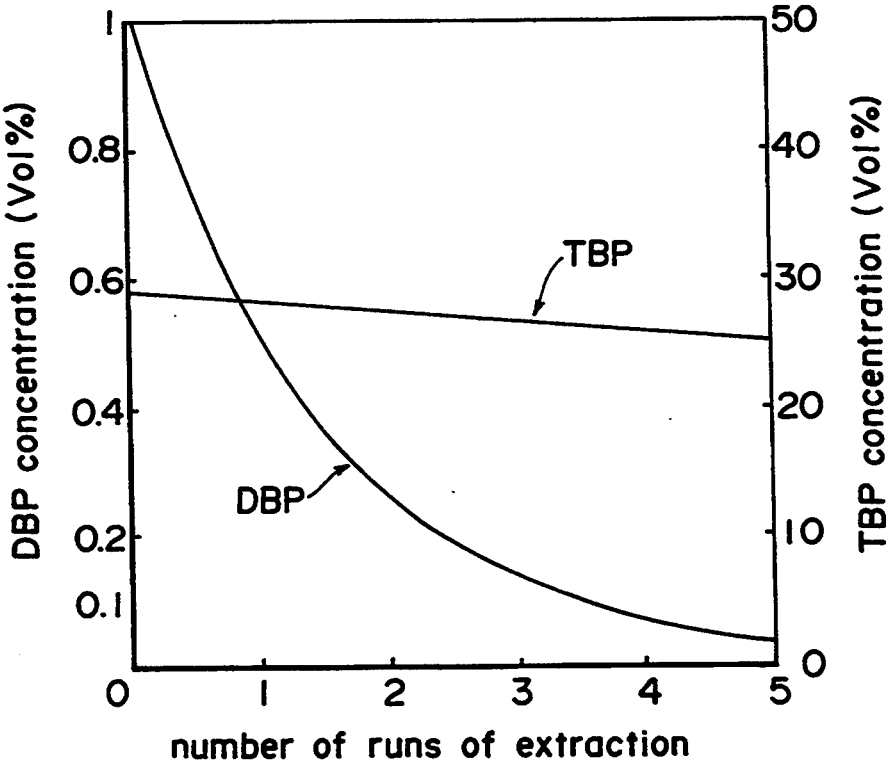
FIG. 3 is a graph showing the relationship between the change in concentration of DBP and TBP in the non-methanol/water phase and the number of runs of the extraction obtained after repeated extraction with a methanol/water mixture.

The same simulated spent solvent as that used in Example 1 was brought into contact with an equal quantity of a methanol/water mixture (water concetration: 500 g/l) at room temperature and the resulting mixture was subjected to phase separation. By this procedure conducted only once, 50% of the total amount of DBP, 5% of the total amount of TBP and 1% of the total amount of dodecane migrated into the methanol/water phase. The obtained non-methanol/water phase was further extracted with a methanol/water mixture. This extraction operation was conducted repeatedly. The relationship between the change in the concentration of DBP and TBP in the non-methanol/water phase and the number of runs of the extraction is given in FIG. 3.

It has been reported that the tolerance of the DBP concentration in the solvent usable in the step of reprocessing spent nuclear fuels should be $10^{-5}$ mol/l or below (see Siddall, T. H.,III:"Solvent Extraction Processes Based on TBP" in Chemical Processing of Reactor Fuels, J. F. Flagg (ed.), Academic, New York, 1961, Chap. V.). It is therefore estimated from the graph of FIG. 3 that such a tolerance value of DBP concentration may be attained by conducting the extraction about 12 times even with a highly degraded spent solvent (1% DBP) as used in this Example.

It will be apparent from the above description that the following advantageous effects can be obtained by the present invention:

1) The regeneration of the solvent comprising dodecane and TBP is possible, since the degradation products such as DBP can be selectively removed from the spent solvent by bringing a methanol/water mixture having a specified water concentration into contact with the spent solvent and subjecting the resulting mixture to phase separation.
2) The regeneration of the spent solvent without the necessity for washing with sodium is made possible. As a result, a vitrification or bituminization facility can be dispensed with and the quantity of a radioactive waste formed by the vitrification or bituminization is remarkably reduced.
3) The solvent can be used stably for a long time by the circulation of the regenerated solvent.
4) Since the phase separation can be effectively conducted and a continuous liquid-liquid separation is possible, the treatment capacity can be improved.
5) Since the process basically comprises a liquid-liquid separation which can be conducted at room temperature, high energy is not necessitated and, therefore, energy and cost can be saved.

What is claimed is:

1. A method for regenerating a spent solvent generated from a nuclear fuel cycle without subjecting the spent solvent to alkali washing sodium hydroxide or sodium carbonate, said spent solvent containing a higher hydrocarbon, tributyl phosphate and degradation products of tributyl phosphate, said method comprising bringing the spent solvent into contact with a methanol/water mixture having a water concentration of 100 to 750 g/l and separating the resulting mixture into a non-methanol/water phase mainly composed of the higher hydrocarbon and tributyl phosphate and a methanol/water phase containing the degradation products of tributyl phosphate.

2. The method according to claim 1, wherein said method further comprises repeatedly subjecting the separated non-methanol/water phase to the contacting step with the methanol/water mixture and the phase separation step.

3. The method according to claim 1, wherein said method further comprises distilling the separated methanol/water phase to selectively recover methanol and water and discarding residual degradation products.

* * * * *

UNITED STATES PATENT AND TRADEMARK OFFICE

CERTIFICATE OF CORRECTION

PATENT NO. : 5,430,226

DATED : July 4, 1995

INVENTOR(S) : Jin OHUCHI, Isao KONDOH and Takashi OKADA

It is certified that error appears in the above-indentified patent and that said Letters Patent is hereby corrected as shown below:

On title page, item [73] change the

Assignee to

--Doryokuro Kakunenryo Kaihatsu Jigyodan--.

Column 4,

Claim 1, line 3, after "washing" insert --with--.

Signed and Sealed this

Nineteenth Day of September, 1995

*Attest:*

*Attesting Officer*

Bruce Lehman

BRUCE LEHMAN

*Commissioner of Patents and Trademarks*